US010499460B2

(12) United States Patent
Yamada

(10) Patent No.: US 10,499,460 B2
(45) Date of Patent: Dec. 3, 2019

(54) HEATER UNIT AND CARBURIZING FURNACE

(71) Applicant: DOWA THERMOTECH CO., LTD., Tokyo (JP)

(72) Inventor: Tsunetaka Yamada, Tokyo (JP)

(73) Assignee: DOWA THERMOTECH CO., LTD., Tokyo (JP)

( * ) Notice: Subject to any disclaimer, the term of this patent is extended or adjusted under 35 U.S.C. 154(b) by 235 days.

(21) Appl. No.: 15/539,983

(22) PCT Filed: Dec. 24, 2015

(86) PCT No.: PCT/JP2015/086073
§ 371 (c)(1),
(2) Date: Jun. 26, 2017

(87) PCT Pub. No.: WO2016/104633
PCT Pub. Date: Jun. 30, 2016

(65) Prior Publication Data

US 2017/0353995 A1 Dec. 7, 2017

(30) Foreign Application Priority Data

Dec. 26, 2014 (JP) ..... 2014-266381

(51) Int. Cl.

| | |
|---|---|
| ***F27D 11/02*** | (2006.01) |
| ***H05B 3/06*** | (2006.01) |
| ***C23C 8/20*** | (2006.01) |
| ***H05B 3/66*** | (2006.01) |
| ***C23C 8/22*** | (2006.01) |

(Continued)

(52) U.S. Cl.
CPC ..... *H05B 3/06* (2013.01); *C23C 8/20* (2013.01); *C23C 8/22* (2013.01); *F27D 7/06* (2013.01); *F27D 11/02* (2013.01); *F27D 11/12* (2013.01); *F27D 99/0006* (2013.01); *H05B 3/66* (2013.01)

(58) Field of Classification Search
CPC ..... F27D 11/12; F27D 7/06
See application file for complete search history.

(56) References Cited

U.S. PATENT DOCUMENTS

| | | | | |
|---|---|---|---|---|
| 4,180,697 | A | 12/1979 | Schumann et al. | |
| 2002/0005404 | A1 | 1/2002 | Maeda et al. | |
| 2017/0353995 | A1* | 12/2017 | Yamada | C23C 8/20 |

FOREIGN PATENT DOCUMENTS

| | | | |
|---|---|---|---|
| CN | 2893595 | Y | 4/2007 |
| JP | S50-049044 | U | 5/1975 |

(Continued)

OTHER PUBLICATIONS

International Search Report issued in Application No. PCT/JP2015/086073, dated Apr. 5, 2016.

(Continued)

*Primary Examiner* — Scott R Kastler
(74) *Attorney, Agent, or Firm* — Michael Best & Friedrich LLP

(57) ABSTRACT

In a heater unit for a carburizing furnace that carburizes a workpiece, a heater that heats a furnace atmosphere; and a heater supporting member that reflects radiant heat of the heater are provided, in which a heat generation part of the heater is attached to the heater supporting member, and a heat generation body composing the heat generation part is formed in a bellows shape.

8 Claims, 5 Drawing Sheets

(51) Int. Cl.

| | |
|---|---|
| ***F27D 7/06*** | (2006.01) |
| ***F27D 11/12*** | (2006.01) |
| ***F27D 99/00*** | (2010.01) |

(56) References Cited

FOREIGN PATENT DOCUMENTS

| | | | |
|---|---|---|---|
| JP | S53-092312 | A | 8/1978 |
| JP | S56-104091 | U | 8/1981 |
| JP | H10-273396 | A | 10/1998 |
| JP | 2000-252047 | A | 9/2000 |
| JP | 2001-074226 | A | 3/2001 |
| JP | 2002-260831 | A | 9/2002 |
| JP | 2011-124048 | A | 6/2011 |
| JP | 2012-233649 | A | 11/2012 |
| JP | 2013-020854 | A | 1/2013 |
| WO | WO-01/45464 | A1 | 6/2001 |

OTHER PUBLICATIONS

Office Action issued in Japanese Application No. 2014-266381, dated Mar. 26, 2019.

* cited by examiner

HEATER UNIT AND CARBURIZING FURNACE

TECHNICAL FIELD

The present invention relates to a heater unit for a carburizing furnace that carburizes a workpiece.

BACKGROUND ART

In a heat treatment furnace that heat treats a treatment object, a heater for heating the furnace atmosphere is provided. As the heater used in the heat treatment furnace, for example, Patent Document 1 describes a sheet metal heater to be used in a continuous heat treatment furnace. Further, Patent Document 2 describes a Kanthal (registered trademark) heater arranged along an inner wall of a heating furnace. Patent Document 3 describes a heater including a U-shaped heating part, or a bellows-shaped heater including a continuous U-shaped heating part. Patent Document 4 describes a bellows-shaped heater provided so as to be horizontally inserted into a heating furnace from its side wall. As above, there are various types of heaters as the heater for a heat treatment furnace.

Such heaters as described above are employed also for a carburizing furnace that carburizes a low-carbon steel workpiece. It is general that a furnace wall of the carburizing furnace is composed of an outer wall (iron shell) and a plurality of heat insulators. The heater for a carburizing furnace is arranged to face the heat insulator located at the innermost of the furnace wall (to be referred to as a "first heat insulator" hereinafter).

However, the heater has a structure to emit heat radially from the heating part, and thus emits heat to the outer wall side as well as to the furnace inner side. That is, the heat is supplied also to the above-described first heat insulator, resulting in that the surface temperature of the furnace inner side of the first heat insulator becomes about 900° C.

In the meantime, inside the carburizing furnace, sooting (a sooting phenomenon) occurs in the furnace due to a carburizing gas to be introduced during carburizing and the carburizing gas remaining after the carburizing. The sooting is likely to occur when the temperature becomes 700 to 800° C. in particular, and an adhesion amount of soot increases in the temperature zone.

As described previously, due to the surface temperature of the furnace inner side of the first heat insulator being 900° C., the surface temperature of the outer wall side of the first heat insulator becomes a temperature of 800° C. or less. That is, the surface temperature of the outer wall side of the first heat insulator becomes the temperature at which the sooting starts to occur. Therefore, in the conventional carburizing furnace, sooting has occurred between the first heat insulator and the heat insulator located on the further outer side of the first heat insulator (to be referred to as a "second heat insulator," hereinafter).

When the sooting continues to occur between the first heat insulator and the second heat insulator, soot increases in thickness between the heat insulators. Thereby, the first heat insulator is pressed out toward the furnace inner side. The case where such a state continues as it is causes a risk that, of the first heat insulator, rising and falling off to the furnace inner side occur. Therefore, "burnout" that burns off the soot that has adhered between the heat insulators has been performed conventionally.

PRIOR ART DOCUMENT

Patent Document

[Patent Document 1] Japanese Laid-open Patent Publication No. 2012-233649

[Patent Document 2] Japanese Laid-open Patent Publication No. 10-273396

[Patent Document 3] Japanese Laid-open Patent Publication No. 2000-252047

[Patent Document 4] Japanese Laid-open Patent Publication No. 2001-74226

DISCLOSURE OF THE INVENTION

Problems to be Solved by the Invention

However, it is impossible to carburize a workpiece while performing the burnout. That is, performing the burnout regularly triggers a reduction in productivity.

The present invention has been made in consideration of the above-described circumstances, and has an object to suppress occurrence of sooting on a surface of an outer wall side of a heat insulator to improve productivity.

Means for Solving the Problems

The present invention that solves the above-described problem is a heater unit for a carburizing furnace, the heater unit for a carburizing furnace including a heater that heats a furnace atmosphere; and a heater supporting member that reflects radiant heat of the heater, in which a heat generation part of the heater is attached to the heater supporting member, and a heat generation body composing the heat generation part is formed in a bellows shape.

The heater unit according to the present invention is attached to a carburizing furnace, thereby enabling the heater supporting member to reflect the radiant heat emitted from the heat generation part to the outer wall side because the heat generation part of the heater is attached to the heater supporting member that reflects the radiant heat. This makes it possible to lower the surface temperature of a furnace inner side of the heat insulator located at the innermost of a furnace wall. Therefore, it is possible to cause sooting to occur on the surface of the furnace inner side of the heat insulator. That is, it is possible to prevent sooting from occurring on the surface of the outer wall side of the heat insulator located at the innermost of the furnace wall.

Effect of the Invention

According to the present invention, it is possible to prevent rising and falling off of a heat insulator that are caused by occurrence of sooting. As a result, it becomes possible to extend a cycle of performing burnout and improve productivity.

MODE FOR CARRYING OUT THE INVENTION

Figure 1:
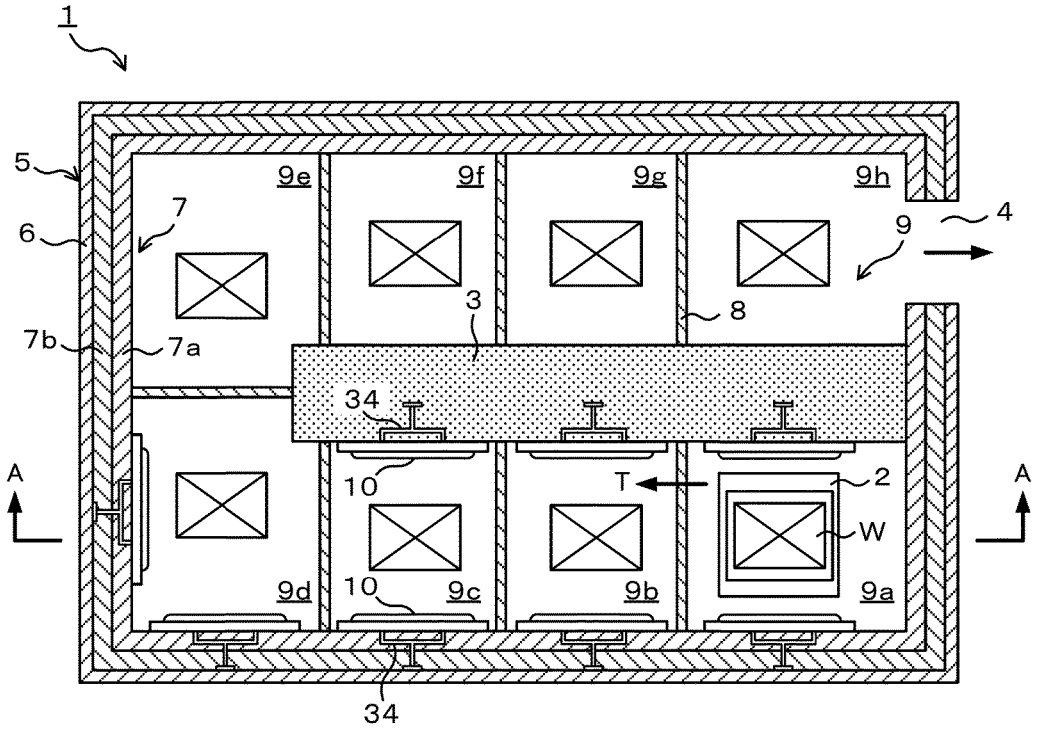
FIG. 1 is a plan view illustrating a schematic constitution of a carburizing furnace according to an embodiment of the present invention.

Hereinafter, there will be explained a heater unit according to an embodiment of the present invention with reference to the drawings. In the following explanation, there will be described an example where the heater unit according to this embodiment is applied to a continuous carburizing furnace that performs a series of heat treatments related to carburizing. Incidentally, in the Description and the drawings, the same reference numerals and symbols are added to the components having substantially the same functional constitutions, and thereby overlapping explanation is omitted.

Figure 2:
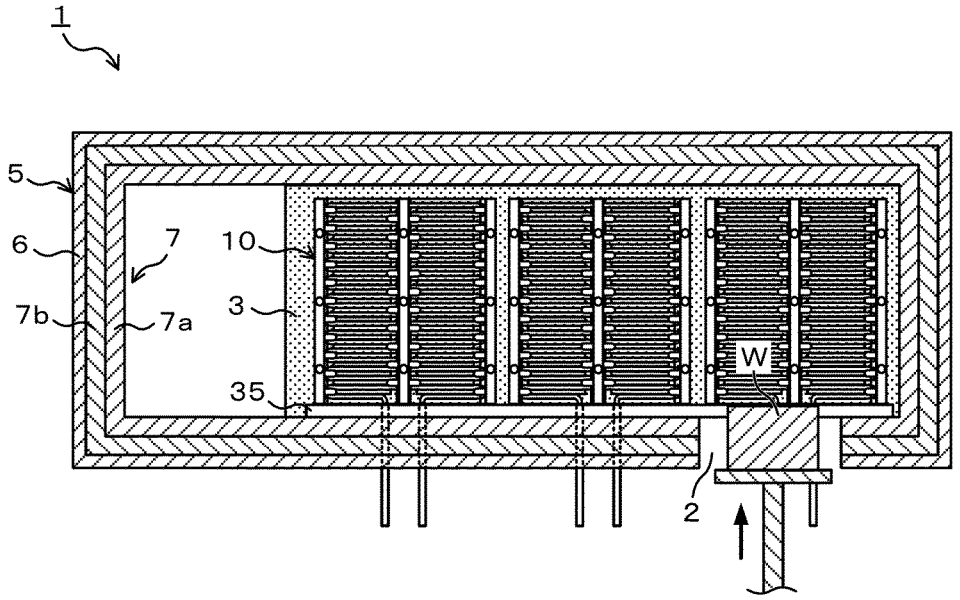
FIG. 2 is a schematic view illustrating a cross section taken along A-A in FIG. 1.

As illustrated in FIG. 1, a carburizing furnace 1 according to this embodiment has a square outer shape in a plan view. In a furnace bed at one corner out of four corners of the carburizing furnace 1, a carry-in port 2 through which a workpiece W is carried in is formed. As illustrated in FIG. 1 and FIG. 2, at a center portion in the carburizing furnace, a heat-resistant brick 3 is arranged so as to extend from one side wall to the other side wall. The heat-resistant brick 3 is provided so as to come into contact with the furnace bed and a ceiling portion. The workpiece W carried in through the carry-in port 2 is carried along the periphery of the heat-resistant brick 3. In a side wall portion of the carburizing furnace 1 located downstream in a workpiece carrying direction T, a carry-out port 4 through which the workpiece W is carried out is formed.

A furnace wall 5 of the carburizing furnace 1 is composed of an outer wall 6 made of an iron shell and the like and a heat insulator 7 provided on the inner side of the outer wall 6. The heat insulator 7 has a multilayered structure composed of a first heat insulator 7*a* located at the innermost of the furnace wall 5 and a second heat insulator 7*b* provided on the outer side of the first heat insulator 7*a*. Incidentally, for the heat insulator 7 composing the furnace wall 5, a high performance heat insulator such as, for example, ROSLIM (registered trademark) Board is preferably used.

Further, a plurality of raising and lowering partition doors 8 (not illustrated in FIG. 2) are provided in the furnace. When these partition doors 8 are closed, a plurality of enclosed spaces are formed by the partition doors 8, the furnace wall 5, and the heat-resistant brick 3. The enclosed spaces each function as a heat treatment chamber 9 that performs a desired heat treatment on the workpiece W.

In the carburizing furnace 1 according to this embodiment, the furnace is partitioned into eight parts by the partition doors 8. The respective heat treatment chambers 9 function as a first temperature increasing chamber 9*a*, which is a heat treatment chamber with the carry-in port 2 formed therein, a second temperature increasing chamber 9*b*, a first carburizing chamber 9*c*, a second carburizing chamber 9*d*, a third carburizing chamber 9*e*, a diffusing chamber 9*f*, a temperature lowering chamber 9*g*, and a quenching chamber 9*h* in the order along the carrying direction T.

Further, on the side wall portion and the heat-resistant brick 3 of the carburizing furnace 1, heater units 10 that heat the furnace atmosphere are provided. The heater units 10 are arranged in the heat treatment chambers 9 in the first half of a carry line in order to heat the workpiece W carried in a low-temperature state. In this embodiment, the heater unit 10 is provided in each of the heat treatment chambers 9 ranging from the first temperature increasing chamber 9*a* to the second carburizing chamber 9*d*.

Figure 3:
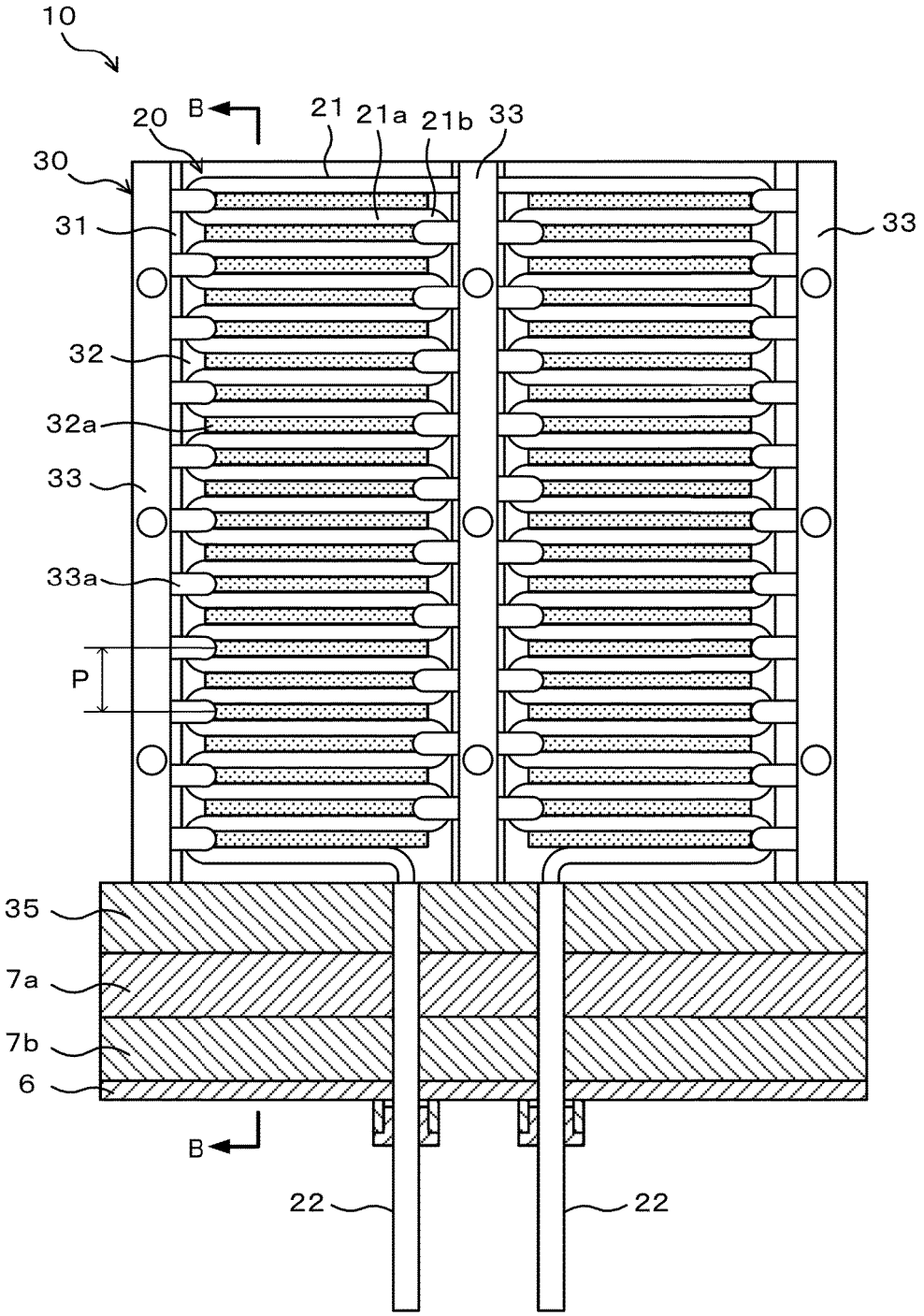
FIG. 3 is a front view illustrating a schematic constitution of a heater unit according to the embodiment of the present invention.
Figure 4:
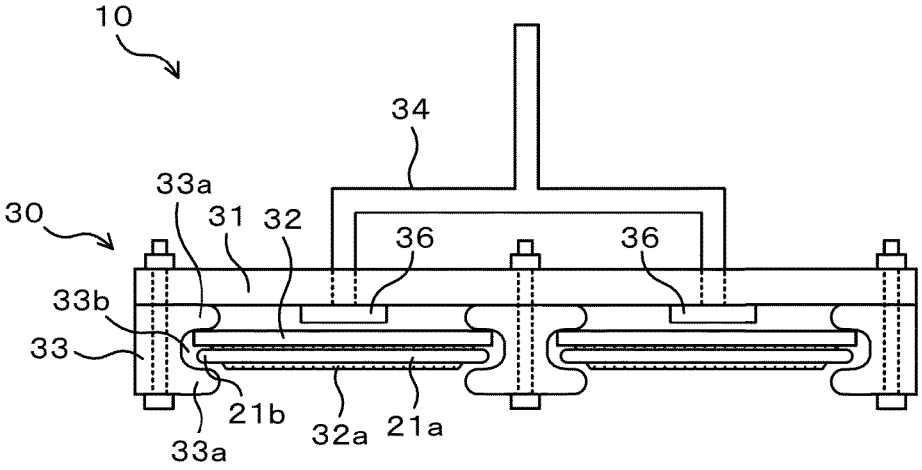
FIG. 4 is a plan view illustrating a schematic constitution of the heater unit according to the embodiment of the present invention.
Figure 5:
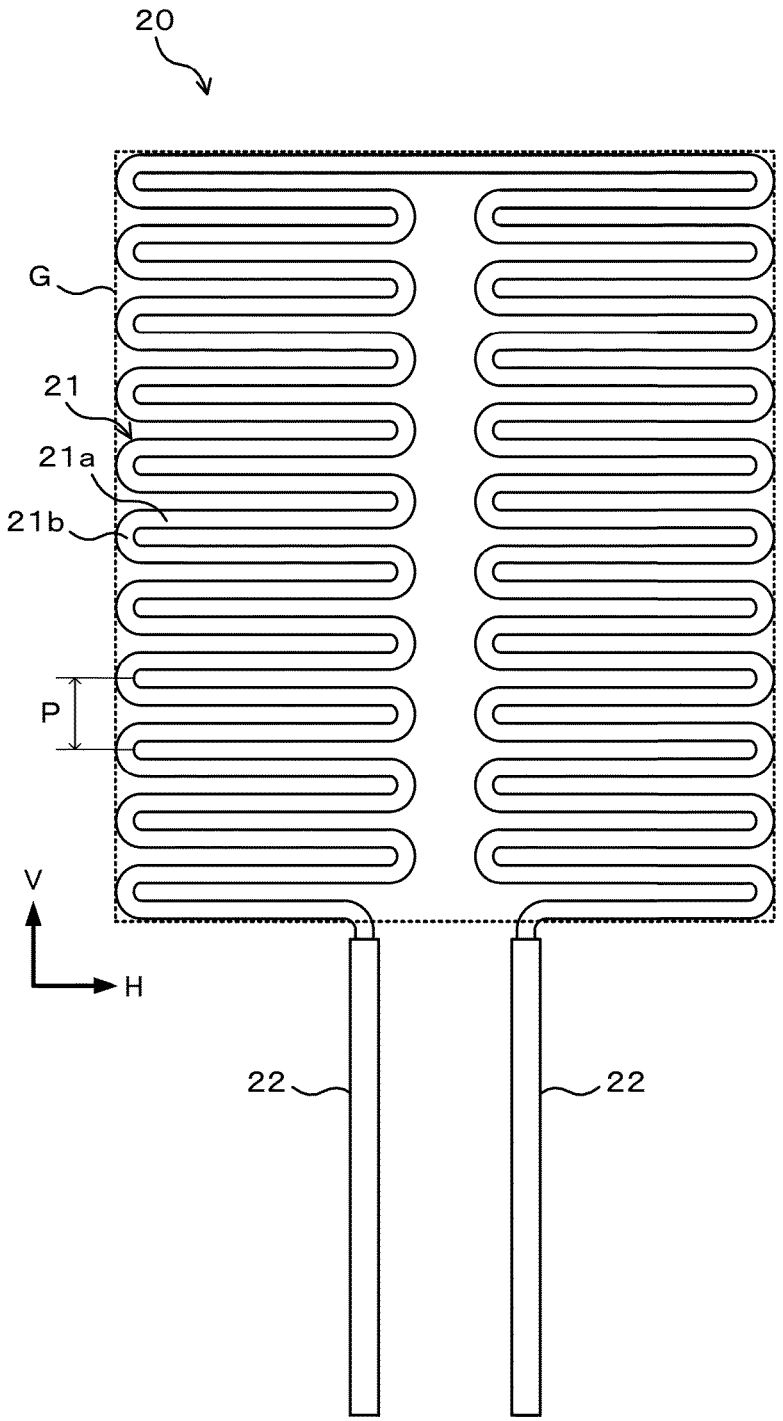
FIG. 5 is a front view illustrating a schematic composition of a heater according to the embodiment of the present invention.

As illustrated in FIG. 3 and FIG. 4, the heater unit 10 according to this embodiment is constituted of a heater 20 to be a heat generation source and a heater supporting member 30. As illustrated in FIG. 5, the heater 20 according to this embodiment is composed of a heat generation part G formed of a heat generation body 21 (for example, a Kanthal wire) and lead wires 22 connected to both end portions of the heat generation body 21. The heat generation body 21 is a single tubular member and is formed in a bellows shape in a manner to be bent repeatedly between the portion connected to the one lead wire 22 and the portion connected to the other lead wire 22.

Straight parts 21*a* of the heat generation body 21 are formed to be vertical to a longitudinal direction of the heat generation part G in such a heater front view as illustrated in FIG. 5. Here, the "heat generation part" in the Description means a part surrounded by a horizontal plane and a vertical plane that are in contact with the heat generation body 21 in such a heater front view as illustrated in FIG. 5. The heat generation part G in this embodiment is a part surrounded by a dotted line illustrated in FIG. 5. Incidentally, in this embodiment, in terms of the length of the heat generation part G in a heater front view, the length in a vertical direction V is longer than that in a horizontal direction H, and thus the vertical direction V results in the longitudinal direction of the heat generation part G.

The heat generation body 21 elongates due to thermal expansion during heat generation, and when this elongation accumulates in the same direction, the heater 20 is liable to fall off from the heater supporting member 30. For example, when the straight parts 21*a* of the heat generation body 21 are oriented to the longitudinal direction of the heat generation part G, elongation in the same direction is likely to accumulate. Therefore, the heater 20 is liable to fall off from the heater supporting member 30. Further, in a state where the elongation in the same direction is likely to accumulate, the straight parts 21 elongate due to thermal expansion, and thereby in such a plan view as illustrated in FIG. 4, such a warp as to cause a bent part 21*b* of the heat generation body 21 to be located forward or rearward of the straight part 21*a* is liable to occur. Therefore, planarity of the heater 20 is impaired to cause a risk that a heat distribution becomes nonuniform.

In contrast to this, the straight parts 21*a* of the heat generation body 21 according to this embodiment are, as described previously, formed to be vertical to the longitudinal direction of the heat generation part G. This makes it possible to reduce accumulation of elongation caused by thermal expansion. Thereby, it is possible to suppress occurrence of failures such that the heater 20 falls off from the heater supporting member 30. Further, as compared to the case where the straight parts 21*a* are oriented to the longitudinal direction of the heat generation part G, the warp caused by thermal expansion of the heat generation body 21 can be suppressed. This makes it possible to maintain the planarity of the heater 20, resulting in that it is possible to prevent the heat distribution from becoming nonuniform.

Figure 6:
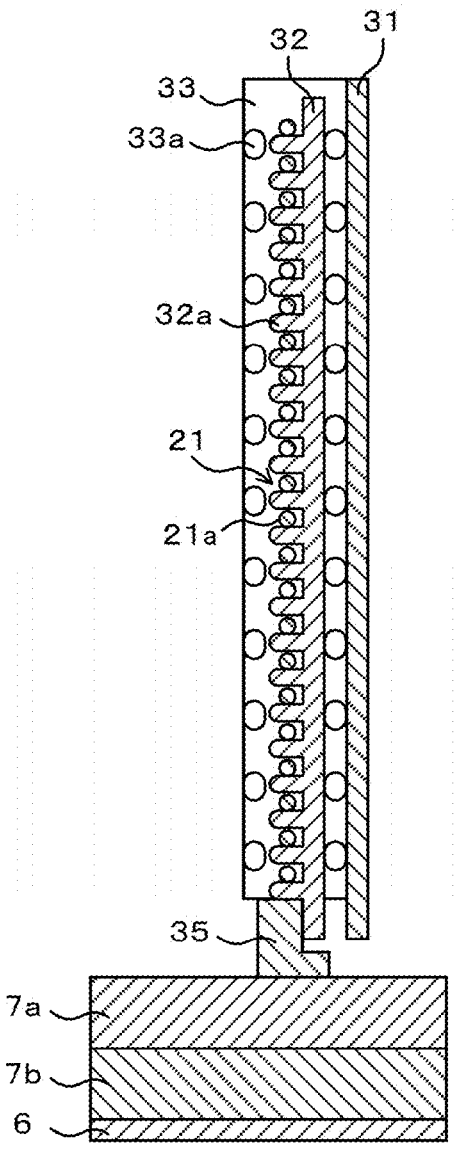
FIG. 6 is a schematic view of a cross section taken along B-B in FIG. 3.

Further, the heat generation body 21 according to this embodiment, as illustrated in a longitudinal sectional view in FIG. 6, has such a shape that the straight parts 21*a* are aligned on a straight line. That is, the heat generation body 21 of the heater 20 is formed in a planar shape so that all the straight parts 21*a* come into contact with an arbitrary one planar surface in a side view. The heat generation body 21 is formed in a planar shape in a side view as above, thereby making it possible to uniformize the amount of heat that the heat generation body 21 emits to the furnace atmosphere, resulting in facilitation of uniformization of the furnace temperature. This makes it possible to improve the quality of carburizing.

As illustrated in FIG. 3 and FIG. 4, the heater supporting member 30 is composed of a rear plate 31, reflectors 32 to reflect radiant heat of the heater 20, and support members 33 to limit movement of the heat generation body 21 to the furnace inner side. Incidentally, the rear plate 31 is formed of SiC, for example, and the reflector 32 and the support member 33 are formed of mullite, for example.

As illustrated in FIG. 3 and FIG. 4, the rear plate 31 and the support members 33 are fixed by bolts. The support member 33 is provided at each of both end portions and a middle portion of the rear plate 31. As illustrated in a plan view in FIG. 4, at each of the support members 33, projection parts 33*a* each projecting in the longitudinal direction of the straight part 21*a* of the heat generation body 21 are formed. The projection parts 33*a* are formed as above, and thereby recess parts 33*b* are also formed. The recess part 33*b* is formed to cover the front of the bent part of the heat generation body 21 and the rear of an end portion of the reflector.

Each of the projection parts 33*a* has such a length as to cover the bent part 21*b* of the heat generation body 21 as illustrated in FIG. 3. Therefore, even if the heat generation body 21 almost moves to the furnace inner side, the projection parts 33*a* (to be referred to as "bent supporting parts 33*a*" hereinafter) can limit the movement of the bent parts 21*b* of the heat generation body 21. This makes it possible to prevent the heater 20 from falling off from the heater supporting member 30.

Further, the bent supporting part 33*a* does not cover the whole of the bent part 21*b* of the heat generation body 21, but covers only a part of the bent part 21*b* in such a plan view as illustrated in FIG. 3. This increases exposed areas of the bent parts 21*b* of the heat generation body 21, thus enabling an increase in amount of heat to be emitted to the furnace inner side.

Further, a plurality of the bent supporting parts 33*a* are provided, and are provided at the same interval as an interval P of the adjacent bent parts 21*b* of the heat generation body 21. Therefore, the exposed areas of the bent parts 21*b* in a heater front view become equal to one another. This makes it possible to uniformize the amount of heat to be emitted to the furnace inner side from the heat generation body 21. As a result, it becomes possible to maintain soaking of the furnace atmosphere and improve the quality of carburizing.

Further, a structure is made in which the bent part 21*b* of the heat generation body 21 and the end portion of the reflector 32 are arranged in the recess part 33*b*, thereby enabling facilitation of setting of a space to be formed between the heat generation body 21 and the reflector 32. Further, by the bent parts 21*b* being arranged in the recess parts 33*b*, displacement of the heater 20 from an installation position, which is caused by thermal expansion of the heat generation body 21, can be prevented.

Incidentally, the space of 5 mm or more is preferably formed between the heat generation body 21 and the reflector 32. This makes it possible to improve a later-described effect of reflecting radiant heat. In the meantime, the space between the heat generation body 21 and the reflector 32 is preferred to be 200 mm or less. When the space exceeds 200 mm, the volume of the furnace needs to be increased, leading to an increase in size of the furnace. The further preferred space between the heat generation body 21 and the reflector 32 is 5 mm or more and 100 mm or less.

Further, a space of 5 mm or more and 200 mm or less is preferably formed between the rear plate 31 and the reflector 32. Increasing the space between the rear plate 31 and the reflector 32 leads to an increase in size of the furnace. The further preferred space between the rear plate 31 and the reflector 32 is 5 mm or more and 10 mm or less.

Further, as illustrated in FIG. 4, a tip portion of a fixing bracket 34 is attached to the rear of the rear plate 31. The tip portion of the fixing bracket 34 is formed in a bifurcated shape and is in a state of passing through the rear plate 31. Further, each flat plate member 36 is attached to the tip portions of the fixing bracket 34. On the other hand, a rear end portion of the fixing bracket 34 is attached to the outer wall 6 of the furnace wall 5, or is in a state of being embedded in the heat-resistant brick 3 as illustrated in FIG. 1. Attaching the fixing bracket 34 as above makes it possible to prevent the rear plate 31 from fall forward. This prevents the heater unit 10 from falling down to the furnace inner side.

Further, on the reflectors 32, straight supporting parts 32*a* that support the straight parts 21*a* of the heat generation body 21 are provided. The straight supporting parts 32*a* are each formed so as to project between the adjacent straight parts 21*a* of the heat generation body 21 in a side view illustrated in FIG. 6.

Further, as illustrated in FIG. 3 and FIG. 6, between the heat generation part G of the heater 20 and the first heat insulator 7*a*, a reflector supporting block 35 that supports the reflectors 32 is provided. The straight supporting part 32*a* located at the lowermost portion of the reflector 32 has a lower surface thereof in a state of being in contact with the reflector supporting block 35. Thereby, the position in the vertical direction of the reflector 32 is restricted. Incidentally, the reflector supporting block 35 is formed of, for example, SK38 being heat-resistant brick.

Further, each of the straight supporting parts 32*a* of the reflector 32 also has a function of preventing abnormal heating of the heat generation body 21. When the heat generation body 21 is formed in a bellows shape, heat gathers inside the bent parts 21*b* of the heat generation body 21, so that abnormal heating becomes likely to occur. In contrast to this, each of the straight supporting parts 32*a* according to this embodiment is formed so as to be equal in length to the length of the straight part 21*a* of the heat generation body 21. This makes it possible to easily let the heat gathering inside the bent parts 21*b* go via the straight supporting parts 32*a*. As a result, it becomes possible to prevent the abnormal heating in the bent parts 21*b* of the heat generation body 21.

The heater unit 10 according to this embodiment is constituted as above.

Even in such a heater unit 10, heat is emitted radially from the heat generation body 21 similarly to the conventional one. That is, the heat to be emitted is emitted not only to the furnace inner side but also to the rear plate side (outer wall side). However, the heater unit 10 according to this embodiment includes the reflectors 32 that reflect radiant heat provided on the rear plate 31 side of the heat generation part G. Therefore, the radiant heat to be emitted to the rear plate 31 side is reflected by the reflectors 32. Thereby, it is possible to suppress a rise in temperature of the rear of the rear plate 31 (the surface of the outer wall side).

As a result, the temperature between the heater unit 10 and the first heat insulator 7*a* becomes a temperature at which sooting is likely to occur. That is, sooting becomes likely to occur between the heater unit 10 and the first heat insulator 7*a*, and becomes unlikely to occur between the first heat insulator 7*a* and the second heat insulator 7*b*. This makes it possible to prevent occurrence of rising, falling off, and the like of the first heat insulator 17*a* that are caused by progress of sooting.

On the other hand, sooting continues to progress between the heater unit 10 and the first heat insulator 7*a*. Therefore, it is still necessary to perform periodical burnout. However, the heater unit 10 no longer falls down to the furnace inner side because the fixing bracket 34 is attached to the rear plate 31. Further, in this embodiment, the heat generation body 21 of the heater 20 is limited in movement to the furnace inner side by the bent supporting parts 33*a*.

Therefore, even if sooting progresses to some extent, a problem such that the heat generation body 21 falls down to the furnace inner side does not occur, so that it is possible to perform a desired heat treatment. As a result, it becomes possible to reduce the frequency of performance of burnout work more than ever before. Thereby, it is possible to increase a carburizing amount of the workpiece W until the following maintenance and improve productivity.

Incidentally, the heat generation body 21 of the heater 20, the reflector 32, and the rear plate 31 are preferably arranged to be parallel to one another in such a plan view as illustrated in FIG. 4. Thereby, the radiant heat emitted from the heat generation body 21 and the radiant heat reflected by the reflector 32 become equal in distribution of heat and also in distribution of the temperature of the furnace atmosphere. As a result, it becomes possible to prevent temperature unevenness during carburizing. Further, it also becomes possible to suppress variations in amount of transferred heat received by the rear plate 31, and suppress variations in deposition amount of soot generated on the rear of the rear plate.

In the foregoing, the preferred embodiment of the present invention has been described, but the present invention is not limited to such an example. It is apparent that those skilled in the art are able to devise various variation or modification examples within the scope of the technical spirit described in the claims, and it should be understood that such examples belong to the technical scope of the present invention as a matter of course.

For example, in the above-described embodiment, the heater supporting member 30 is composed of the rear plate 31, the reflectors 32, and the support members 33, but the composition of the heater supporting member 30 and the method of fixing the respective members are not limited to the ones explained in the above-described embodiment. The effect of preventing occurrence of sooting between the heat insulators explained in the above-described embodiment can be enjoyed as long as the heat generation part G of the heater 20 is attached to the heater supporting member 30 including reflecting members. Further, the reflecting member does not need to have a plate shape. Further, the heat insulator 7 composing the furnace wall 5 may have a single-layer structure.

Further, in the above-described embodiment, the Kanthal wire is used as the heat generation body of the heater 20, but the heat generation body is not limited to this. For example, it is also possible to use what is called a gas burner type heat generation body that burns gas at a terminal portion of a radiant tube arranged in a bellows shape. Also in this case, the reflectors 32 are to be provided on the rear side of the heat generation part G of the heater 20, so that it is possible to lower the temperature at the rear side of the rear plate 31.

Further, in the above-described embodiment, the workpiece carrying direction in the carburizing furnace 1 is the vertical direction, but the heater unit 10 according to the invention of the present application is applicable also to a carburizing furnace in which the workpiece carrying direction is the horizontal direction. Further, it is also possible to form the heater 20 and the heater supporting member 30 to have curvature in such a plan view as FIG. 3 and apply them to a circular furnace. Further, the heater unit 10 is not limited to the continuous carburizing furnace, and is applicable also to a batch-type carburizing furnace.

INDUSTRIAL APPLICABILITY

The present invention can be applied to a carburizing furnace that carburizes a workpiece.

EXPLANATION OF CODES

1 carburizing furnace
2 carry-in port
3 heat-resistant brick
4 carry-out port
5 furnace wall
6 outer wall
7 heat insulator
7*a* first heat insulator
7*b* second heat insulator
8 partition door
9 heat treatment chamber
9*a* first temperature increasing chamber
9*b* second temperature increasing chamber
9*c* first carburizing chamber
9*d* second carburizing chamber
9*e* third carburizing chamber
9*f* diffusing chamber
9*g* temperature lowering chamber
9*h* quenching chamber
10 heater unit
20 heater
21 heat generation body
21*a* straight part of heat generation body
21*b* bent part of heat generation body
22 lead wire
30 heater supporting member
31 rear plate
32 reflector
32*a* straight supporting part
33 support member
33*a* bent supporting part
33*b* recess part
34 fixing bracket
35 reflector supporting block
36 flat plate member
G heat generation part
H horizontal direction
P interval of bent part
T workpiece carrying direction
V vertical direction
W workpiece

The invention claimed is:

1. A heater unit for a carburizing furnace, comprising:
a heater that heats a furnace atmosphere; and
a heater supporting member includes a reflector that reflects radiant heat of the heater, wherein a heat generation part of the heater is attached to the heater supporting member, a heat generation body composing the heat generation part is formed in a bellows shape, and in the heater supporting member, a recess part that covers the front of a bent part of the heat generation body and the rear of an end portion of the reflector is provided.

2. The heater unit for a carburizing furnace according to claim 1, wherein the heater supporting member includes a rear plate on a rear side of the reflector.

3. The heater unit for a carburizing furnace according to claim 2, wherein the heat generation body, the reflector, and the rear plate are arranged to be parallel to one another in a plan view.

4. The heater unit for a carburizing furnace according to claim 1, wherein a straight part of the heat generation body is vertical to a longitudinal direction of the heat generation part in a front view.

5. The heater unit for a carburizing furnace according to claim 1, wherein the heater supporting member includes a bent supporting part that covers a part of the bent part of the heat generation body in a front view.

6. The heater unit for a carburizing furnace according to claim 1, wherein the heater supporting member includes a straight supporting part that supports the straight part of the heat generation body, and the straight supporting part is formed to project between the adjacent straight parts of the heat generation body.

7. The heater unit for a carburizing furnace according to claim 1, wherein the heat generation body is formed in a planar shape in a side view.

8. A carburizing furnace that carburizes a workpiece, the carburizing furnace, comprising:

the heater unit for a carburizing furnace according to claim 1.

* * * * *